United States Patent [19]

Johannson

[11] 4,392,773

[45] Jul. 12, 1983

[54] CARRIAGE ASSEMBLY WITH SHIFTABLE FORKS

[75] Inventor: Richard J. Johannson, Dallas, Oreg.

[73] Assignee: Towmotor Corporation, Mentor, Ohio

[21] Appl. No.: 261,105

[22] PCT Filed: Sep. 22, 1980

[86] PCT No.: PCT/US80/01265

§ 371 Date: Sep. 22, 1980

§ 102(e) Date: Sep. 22, 1980

[87] PCT Pub. No.: WO82/00997

PCT Pub. Date: Apr. 1, 1982

[51] Int. Cl.[3] ..... B66F 9/12

[52] U.S. Cl. ..... 414/667

[58] Field of Search ..... 414/785, 664–671, 414/621

[56] References Cited

U.S. PATENT DOCUMENTS

| | | | |
|---|---|---|---|
| 2,788,148 | 4/1957 | Parcell | 414/621 |
| 2,886,197 | 5/1959 | Harris | 414/667 |
| 2,904,203 | 9/1959 | Mindrum | 414/667 |
| 3,066,807 | 12/1962 | Draxler | 414/667 |
| 3,106,305 | 10/1963 | Gehring | 414/666 |
| 3,381,834 | 5/1968 | Gibson | 414/664 |
| 3,589,541 | 6/1971 | Melin | 414/668 |
| 3,974,927 | 8/1976 | Schuster | 414/667 |
| 3,999,675 | 12/1976 | Forry | 414/667 |

*Primary Examiner*—Trygve M. Blix
*Assistant Examiner*—Jesus D. Sotelo
*Attorney, Agent, or Firm*—Alan J. Hickman

[57] ABSTRACT

It is desirable to have relatively clear forward and downward vision for the operator of a lift truck which has a side shiftable carriage. Herein, a structure (52) mounts a top end portion (40) of a vertical leg (38) of a tine (36) to transfer substantially only horizontal forces to an upper bar (26) of a side shifter (24). A structure (64) serves for mounting a bottom end portion (42) of the vertical leg (38) to transfer vertical forces to a lower bar (28) of the side shifter (24). Since vertical forces are taken up by the lower bar (28), the upper portion of the carriage assembly (16) can be relatively light and small, thus allowing clear forward and downward vision for the vehicle operator. This also results in a total carriage structure which is lighter in weight.

9 Claims, 6 Drawing Figures

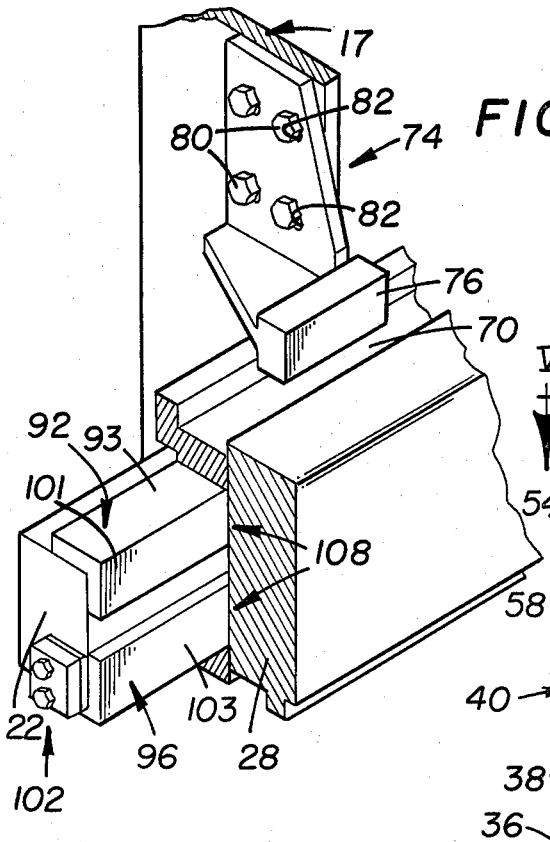
FIGURE 3A
FIGURE 3B
FIGURE 2
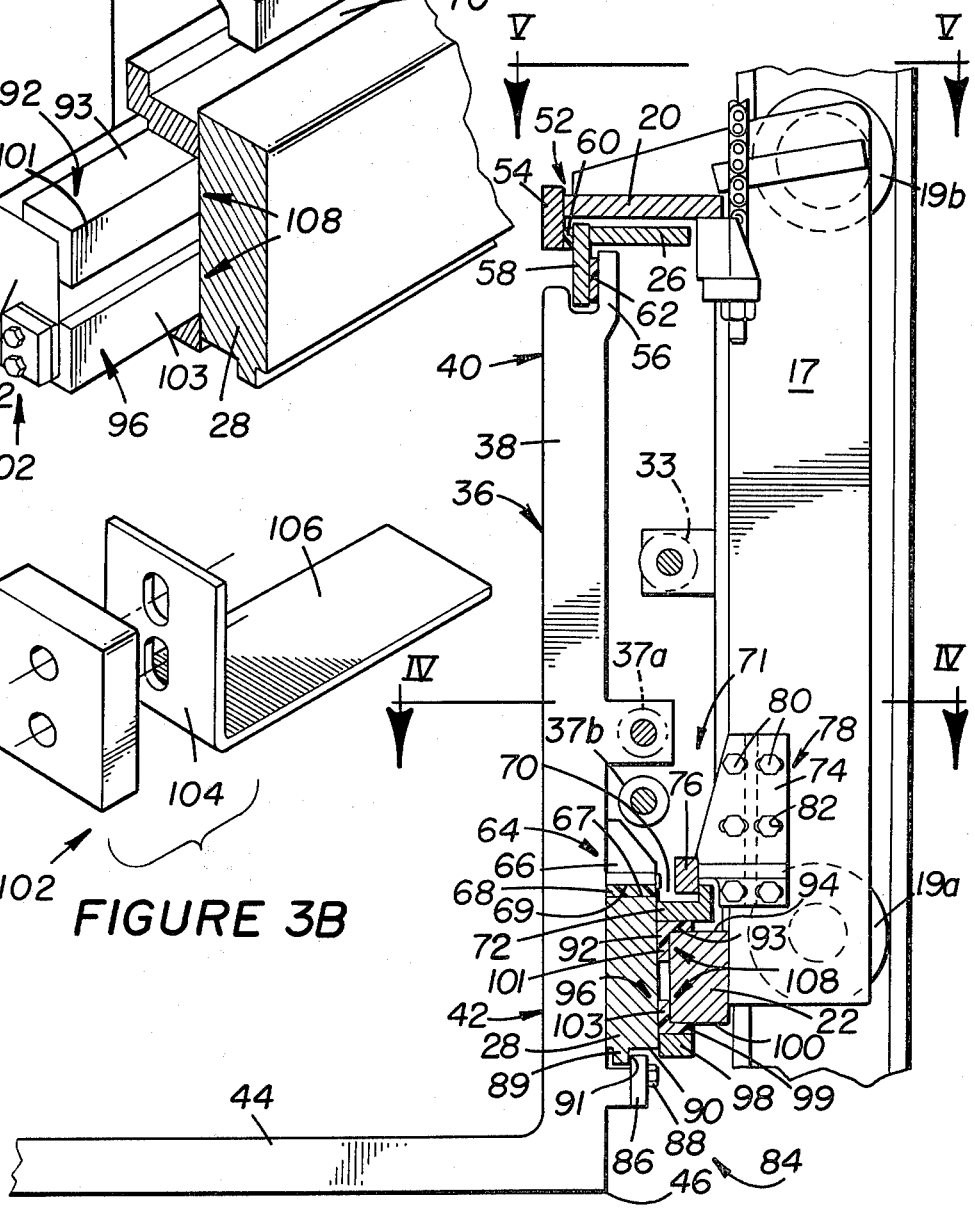

CARRIAGE ASSEMBLY WITH SHIFTABLE FORKS

DESCRIPTION

1. Technical Field

This invention relates generally to a carriage assembly having a laterally shiftable fork structure and more particularly to such an assembly mounted to a mast structure of a lift truck.

2. Background Art

In the construction of vehicles, as for example a lift truck as shown in U.S. Pat. No. 3,999,675 which issued Dec. 28, 1976, to James E. Forrey et al., both vertical and horizontal force components from the fork, are commonly taken up by the top portion of the carriage assembly. Thus, it is required that the top portion of the carriage assembly by relatively large and heavy to carry the vertical force components. Because of the size and location of the top portion of the carriage assembly, forward downward vision of the operator of the lift truck can be somewhat restricted. Because of the weight of the top portion, the cost of the structure is somewhat high.

In carriage assemblies which have a side shifter, that is, a frame which shifts laterally relative to the mast assembly and carries the forks with it, it is particularly important to have clear forward and downward vision for the lift truck operator, since this allows the operator to visually follow lateral movement and downward tilting of the forks and associated load.

While some structures exist wherein the top portion of a carriage assembly does not accept any vertical forces, but only horizontal forces resulting from the moment created by a load held by the forks of such an assembly, such structures have not been utilized with a carriage assembly which includes a side shifter. U.S. Pat. No. 3,381,834, issued May 7, 1968, to C. B. Gibson, illustrates a lift truck wherein there is no vertical load accepting ability in the upper portion of the carriage assembly and where the entire vertical load upon the forks is taken up by a structure beneath the forks. Such an assembly is not readily adaptable for use with side shifting carriage assemblies.

The present invention is directed to overcoming one or more of the problems as set forth above.

DISCLOSURE OF THE INVENTION

In one aspect of the present invention, a load lifting apparatus has a mast assembly and a carriage assembly. The carriage assembly has an upper member and a lower member and is mounted to and translatable along the mast assembly. A side shifter, having upper and lower bars, is mounted to and laterally translatable along the upper and lower members. A generally "L" shaped tine has a generally vertical leg and a generally horizontal leg. Means are provided for mounting a top end portion of the vertical leg to transfer substantially only horizontal forces to the upper bar. Means are also provided for mounting the bottom end portion of the leg to transfer vertical forces to the lower bar. Further, means are provided for maintaining the lower bar from moving laterally away from the lower member, said means being free from interference with relative longitudinal movement between the lower bar and lower member.

A structure as set out above has the advantage that all vertical forces are taken up by the lower portion of the carriage assembly. As a result, the upper portion of the carriage assembly can be relatively small. This allows relatively free forward and downward view for an operator of a lift truck which has such a carriage assembly. Also, the ability of the assembly to lift a load is improved since the effective lever arm, from the load on the tines to the lower portion of the carriage assembly, is shorter than the effective lever arm in prior art structures (from the load to the upper portion of the carriage assembly). Further, side shifting is provided. Also, a close fit can be maintained between the lower member and the lower bar and apparatus can be provided which keeps the tine from rotating away from the side shifter and which can be easily removed to replace or repair damaged tines, or to mount tines of specialized shapes and/or sizes.

BRIEF DESCRIPTION OF THE DRAWINGS

FIG. 2 illustrates, in side sectional partial view, the embodiment of FIG. 1 in further detail;

FIG. 3A illustrates, in partial perspective view, taken looking downwardly and rightwardly from in front and to the left of the truck, a detail in the structure of the embodiment of FIG. 1;

FIG. 3B illustrates, in partial perspective exploded view, a portion of the structure shown in FIG. 3A;

BEST MODE FOR CARRYING OUT THE INVENTION

Figure 1:
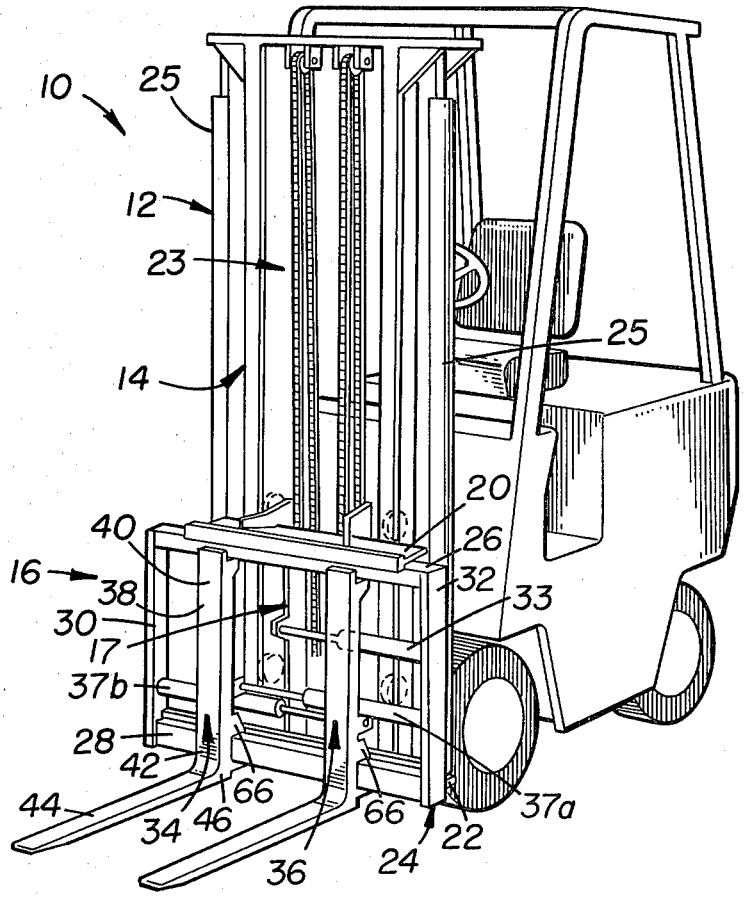
FIG. 1 illustrates, in perspective view, one embodiment of the present invention as mounted to a conventional lift truck.
Figure 4:
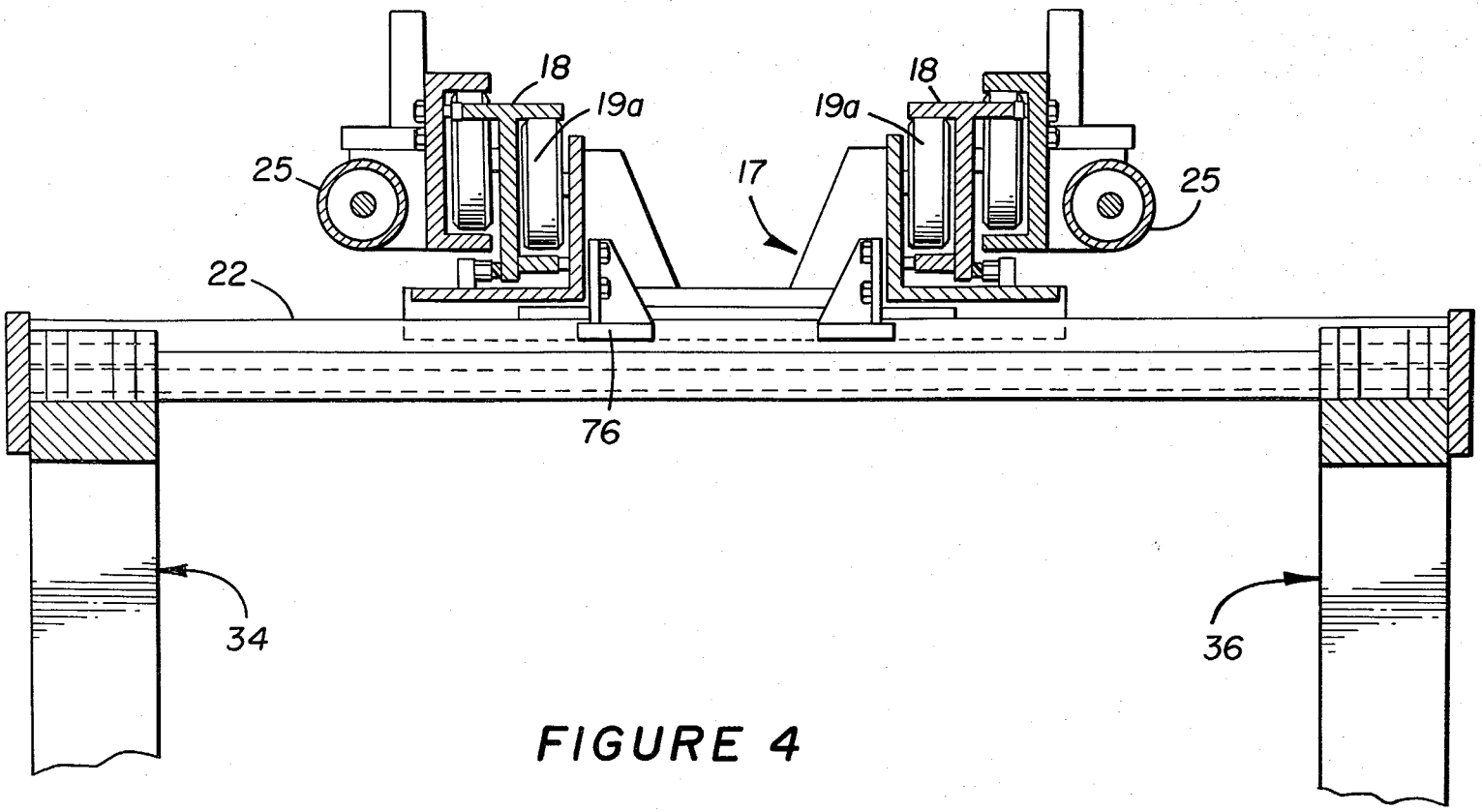
FIG. 4 illustrates a view taken along the line IV—IV of FIG. 2.
Figure 5:
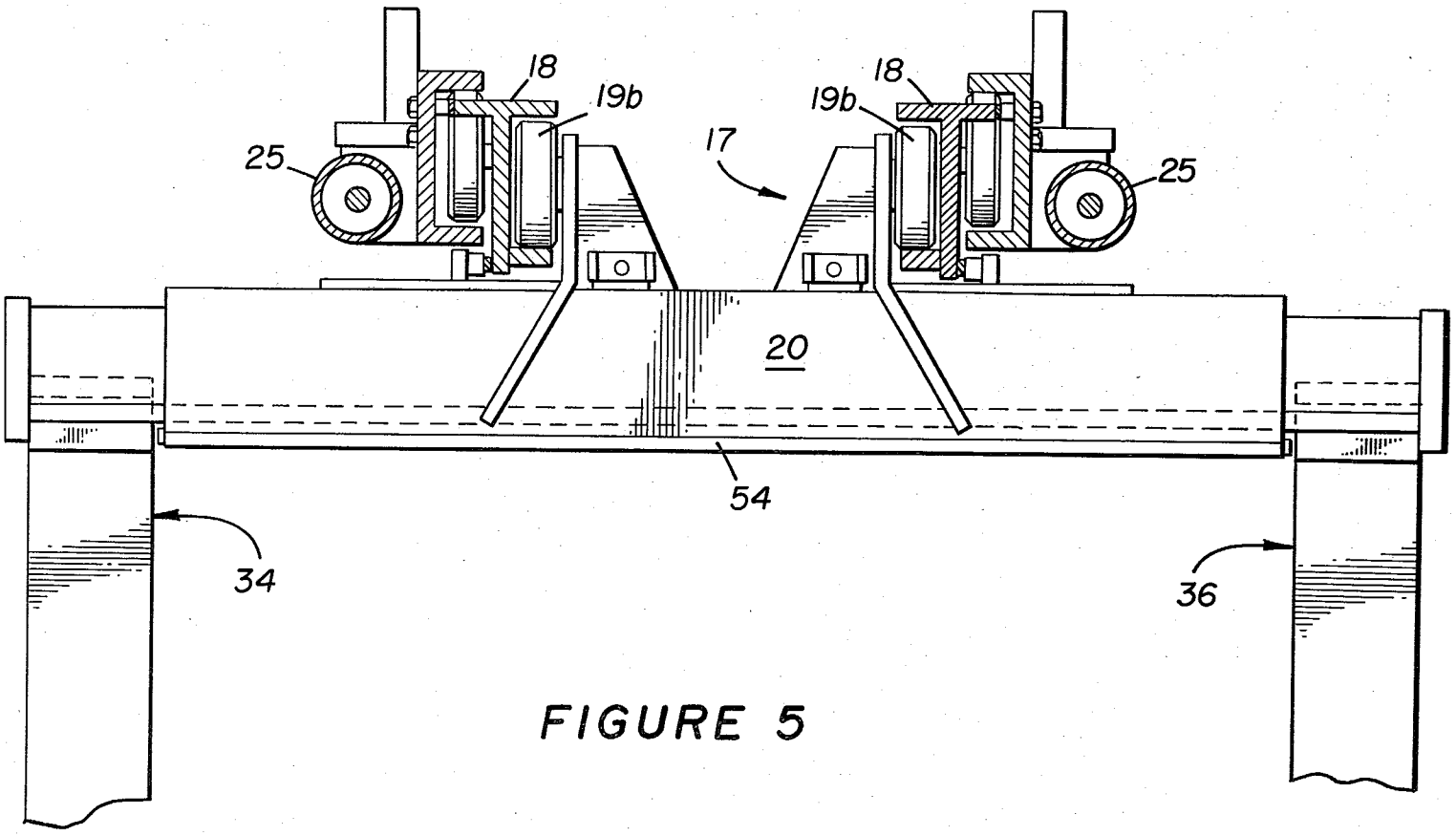
FIG. 5 illustrates a view taken along the line V—V of FIG. 2.

FIG. 1 illustrates a load lifting apparatus or lift truck 10 having a generally vertically oriented mast structure 12 having a frontward facing or fore portion 14. A carriage assembly 16 is mounted to the mast structure 12 for movement vertically up and down along the fore portion 14 thereof. The carriage assembly 16 includes a roller bracket 17, seen best in FIGS. 4 and 5, which rolls within movable uprights 18 on rollers **19*a* and 19*b*. An upper generally horizontal member 20 and a lower generally horizontal member 22 are each connected to the roller bracket 17. A chain assembly 23 pulls the carriage assembly 16 upwardly along the movable uprights 18 as they are raised by cylinders 25**.

A side shifter 24, having an upper generally horizontal bar 26 and a lower generally horizonatal bar 28 connected by a pair of generally vertical side bars 30 and 32, is mounted so that the side shifter 24 is laterally translatable under the impetus of a cylinder 33, along the upper and lower members 20 and 22, with the upper bar 26 being adjacent the lower member 22.

At least one generally "L" shaped tine 34, and generally a pair of such tines 34, 36, is mounted on the side shifter 24. The tines 34, 36 are preferably shifted laterally on the side shifter 24 by cylinders **37*a* and 37*b***, respectively.

The tines 34 and 36 are substantially identical. Generally, the tines 34 and 36 each have a generally vertical leg 38 having a top portion 40 and a bottom portion 42. The tines 34 and 36 also have a generally horizontal leg 44. The generally vertical leg 38 and the generally horizontal leg 44 are joined together at an apex 46. The generally vertical leg 38 is positioned generally parallel to the mast structure 12 with the apex 46 aligned downwardly and joining the bottom portion 42 and the horizontal leg 44. The generally horizontal leg 44 is positioned to extend generally perpendicularly away from the fore portion 14.

In accordance with the illustrated embodiment of the present invention, means 52 are provided for mounting the top end portion 40 of the vertical leg 38 to transfer substantially only horizontal forces to the upper bar 26 of the side shifter 24. Briefly, the means 52 includes a plate 54 attached to extend downwardly from the upper, generally horizontal member 20, preferably to the height of the upper bar 26. Since only horizontal forces are taken up by the upper member 20, it need not be bulky or extend far vertically. Thus, forward vision past the upper member 20 is relatively unobstructed.

An extension 56 of the vertical leg 38 of the tine 36 extends upwardly therefrom adjacent the mast structure 12. A member 58, carried by the upper bar 26 of the side shifter 24, extends downwardly therefrom to a position outboard of the extension 56. Appropriate bearing plates 60 and 62 are positioned respectively between the plate 54 and the member 58 and between the member 58 and the extension 56. Preferably the bearing plates 60, 62 are a plastic material such as UHMW polyethylene.

If a force is exerted downwardly upon the generally horizontal leg 44 of the tine 36, this creates a moment which tends to rotate the extension 56 into bearing contact with the bearing plate 62. Downward forces exerted upon the horizontal leg 44 are not, however, translatable therefrom to the side shifter 24 or to the upper member 20 which is attached to the roller bracket 18.

Means 64 is additionally provided for mounting the bottom end portion 42 of the vertical leg 38 to transfer vertical forces which are exerted downwardly upon the horizontal tine 44 to the lower bar 28 of the side shifter 24. Such forces are then transferred, in a manner which will shortly be apparent, to the lower member 22, and from there, via the roller bracket 18, to the mast structure 12. In the embodiment as illustrated, a pair of arms 66 are carried by the tines 34 and 36 and extend toward the mast structure 12. The arms 66 are positioned and of a construction sufficient to extend to a position above a top 67 of the lower bar 28. An appropriate bearing plate 68, preferably of a plastic material, is attached to a bottom 69 of each of the arms 66 and provides sliding contact between the lower bar 28 and the bracket 66.

Means 71 is provided for maintaining the lower bar 28 from moving laterally away from the lower member 22, while allowing relative longitudinal movement between lower bar 28 and lower member 22. A generally horizontal channel 70 is provided which extends longitudinally along the lower bar 28. In the particular embodiment of illustrated in the drawings, the channel 70 is formed by an "L" shaped bar 72 and the lower bar 28, the "L" shaped bar 72 being attached to the lower bar 28. Generally, the channel 70 opens upwardly. A pair of brackets 74 are connected to the roller bracket 18 and have a finger 76 which extends downwardly into the channel 70.

Means 78 is provided for laterally adjusting the position of the fingers 76 within the channel 70. In the particular embodiment illustrated, the means 78 includes a plurality of bolts 80 which fit within laterally extending slots 82 in the brackets 18. To adjust the lateral positions of the fingers 76, only simply backs off the bolts 80 and slides the brackets 74 leftwardly or rightwardly as desired up to the limits of movement provided by the slots 82. Thereafter, the bolts 80 are simply tightened in place. This assures snug positioning of the side shifter 24 adjacent the lower member 22. Play is thus reduced while side shifting can take place. The side shifter 24 is also prevented from coming off.

Retaining means 84 is provided for retaining the bottom portion 42 of the generally vertical leg 38 of the tine 36 adjacent the lower bar 28. The particular retaining means 84 illustrated includes a structure 86 attached by a retainer, such as a bolt 88, to the tine 36 adjacent its apex 46, and more particularly attached to the bottom portion 42 of the vertical leg 38 of the tine 36. Also part of the retaining means 84 is a ridge 89 which extends downwardly from a bottom 90 of the lower bar 28, the ridge 89 having one side 91 which faces away from the tine 36. The structure 86 is connected to the tine 36 in such a manner that it extends upwardly past the ridge 88 to adjacent the one side 91 of the ridge 89 and the bottom 90 of the lower bar 28. The structure 86 can be removed by removing the bolt 88 whereby the tine 36 can be readily removed.

A first bearing structure 92 is attached to and extends along either the lower bar 28 or the lower member 22 and is in sliding contact with the other thereof. The first bearing structure 92 is positioned to transfer forces downwardly from the lowr bar 28 to the lower member 22. Thus, vertical forces which are transferred from the tines 34 and 36 to the lower bar 28 are further transferred via the "L" shaped member 72 to the lower member 22, which is located below the "L" shaped member 72.

In the particular embodiment illustrated, the first bearing structure 92 is a longitudinally extending bar, preferably of an organic polymeric material such as ultra high molecular weight polyethylene, with the bar having an "L" shaped cross-section with a horizontal leg 93 of the "L" being held between a top surface 94 of the lower member 22 and the bar 72 (which is attached to the lower bar 28 and which, as has previously been mentioned, serves to define the horizontal channel 70). Preferably, the first bearing structure 92 is attached to the lower member 22 and is in sliding contact with the lower bar 28. The lower member 22 is shorter than the lower bar 28.

A second bearing structure 96 is attached to and extends along a respective one of the lower bar 28 and the lower member 22 and is in sliding contact with a respective other thereof. The second bearing structure 96 is positioned to transfer forces upwardly from the lower bar 28 to the lower member 22. In the particular embodiment illustrated the second bearing structure 96 is attached to the lower member 22. That member is somewhat shorter than is the lower bar 28. Generally the second bearing structure 96 is of the same shape as the first bearing structure 92 and of the same material thereof. The bearing plates 60, 62 and 68 are also generally of this same material. A member 98, which may be attached to or may be integral with the lower bar 28, extends therefrom to below the lower member 22. The second bearing structure 96 is attached with a generally horizontal leg 99 thereof in sliding contact between the member 98 and a bottom 100 of the lower member 22. A generally vertical leg 101 of the first bearing structure 92 and a generally vertical leg 103 of the second bearing structure 96 are vertically oriented between the lower member 22 and the lower bar 88 and are preferably in sliding contact with the lower member 28 and attached to the lower member 22.

Adverting particularly to FIGS. 3A and 3B, there is illustrated therein shim means 102 which serves for providing tight sliding contact between the second bearing structure 96 and the bottom 100 of the bar 98. Briefly, an "L" shaped member 104, generally of metal, is positioned with a longer leg 106 thereof between the lower member 22 and the horizontal leg 99 of the second bearing structure 96. The "L" shaped member 104 having a longer leg 106 of a proper thickness to assure good contacting relation between the bar 98 and the horizontal leg of the second bearing structure 96 can be selected at assembly. Alternatively, the shim means 102 could be positioned between the first bearing structure 92 and the top surface 94 of the lower member 22.

The horizontal leg 93 of the first bearing structure 92 serves to transfer forces downwardly from the lower bar 28 to the lower member 22 and the horizontal leg 99 of the second bearing structure 96 serves to transfer forces upwardly from the lower bar 28 to the lower member 22. Meanwhile, the vertical legs 101, 103 of the first bearing structure 92 and the second bearing structure 96, serve as means 108 for providing sliding contact between the lower bar 28 and the lower member 22 for transferring forces generally horizontally inwardly from the lower bar 28 to the lower member 22.

Industrial Applicability

An apparatus as described above is particularly useful with a lift truck wherein loads may be shifted sidewardly relative to a mast assembly and wherein the forks may be shifted sidewardly independently.

In use, vertical forces exerted on the tines 34, 36 are taken up by the lower bar 28. The upper member 20 only takes up horizontal forces and, hence, need not be heavy or bulky, or extend far vertically. This provides reasonably unobstructed forward vision past the upper member 20.

An apparatus in accordance with the present invention has the advantage that the operator has relatively clear forward and downward vision so that he can observe placement of loads laterally of the mast assembly and the picking up of loads in front of the lift truck. The tines or forks of the lift truck can be relatively easily removed as by simply removing the bolt 88, yet all downward forces exerted by the tine are taken up by the bottom portion of the carriage and mast assembly. The overall weight of the device can be reduced, since the bottom portion of the carriage is nearer the position on the forks, where loads are borne than is the upper portion of the carriage. As a result, it is not required to be as strong (and heavy) as are the upper portions of prior art carriages. Adjustments are provided so that a close fitting construction is maintained, even if manufacturing tolerances are relatively large.

Other aspects, objects and advantages of this invention can be obtained from a study of the drawings, the disclosure and the appended claims.

I claim:

1. In a load lifting apparatus (10) having a generally vertically oriented mast assembly (12) and a carriage assembly (16) having an upper generally horizontal member (20) and a lower generally horizontal member (22) and being mounted to and translatable along said mast assembly (12), a side shifter (24) having upper (26) and lower (28) generally horizontal bars connected together and being mounted to and laterally translatable along said members (20 and 22), and a generally "L" shaped tine (36) having a generally vertical leg (38) having a top end portion (40) and a bottom end portion (42) and a generally horizontal leg (44) being associated with said side shifter (24), the improvement comprising:

a roller bracket (17) connected to said generally horizontal members (20 and 22) and rollably mounted on said mast assembly (12);

means (52) for mounting said top end portion (40) of said vertical leg (38) for transferring substantially only horizonal forces from said tine (36) to said upper bar (26);

means (64) for mounting said bottom end portion (42) of said leg (38) for transferring vertical forces directly from said bottom end portion (42) of said vertical leg (38) of said tine (36) to said lower bar (28); and means (71) for maintaining said lower bar (28) from moving laterally away from said lower member (22), said means (71) being free from interference with relative longitudinal movement between said lower bar (28) and said lower member (22), said maintaining means (71) having a bracket (74) and being connected to said roller bracket (17), said bracket having a finger and said lower bar (28) having a channel (70), said channel (70) extending longitudinally along said lower bar (28) and said finger (76) extending into said channel (70).

2. The apparatus (10) as set forth in claim 1, further including:

means (78) for laterally adjusting the position of said finger (76) within said channel (70).

3. The apparatus (10) as set forth in claim 1, further including:

retaining means (84) for retaining said vertical leg (38) adjacent said lower bar (28); and means (88) for removably securing said retaining means (84) to a respective one of said tine (36) and said lower bar (28).

4. The apparatus (10) as set forth in claim 1, wherein said means for mounting said bottom end portion (64) includes an arm (66) having a bottom (69) and being attached to and extending inwardly from said vertical leg (38) of said tine (36), said bottom (69) being slidingly supported on said lower bar (28).

5. In a load lifting apparatus (10) having a generally vertically oriented mast assembly (12) and a carriage assembly (16) having an upper generally horizontal member (20) and a lower generally horizontal member (22) and being mounted to and translatable along said mast assembly (12), a side shifter (24) having upper (26) and lower (28) generally horizontal bars connected together and being mounted to and laterally translatable along said members (20 and 22), and a generally "L" shaped tine (36) having a generally vertical leg (38) having a top end portion (40) and a bottom end portion (42) and a generally horizontal leg (44) being associated with said side shifter (24), the improvement comprising:

means (52) for mounting said top end portion (40) of said vertical leg (38) for transferring substantially only horizontal forces from said tine (36) to said upper bar (26);

means (64) for mounting said bottom end portion (42) of said leg (38) for transferring vertical forces from said tine (36) to said lower bar (28);

means (71) for maintaining said lower bar (28) from moving laterally away from said lower member (22), said maintaining means (71) being free from interference with relative longitudinal movement between said lower bar (28) and said lower member (22);

retaining means (84) for retaining said vertical leg (38) adjacent said lower bar (28);

means (88) for removably securing said retaining means (84) to a respective one of said tine (36) and said lower bar (28); and wherein said lower bar (28) has a top (67) and a bottom (90) and said retaining means (84) includes a ridge (89) extending from said lower bar (28) and a structure (86) connected to said tine (36), said ridge (89) having one side (91) facing away from said tine (36), said ridge (89) extending downwardly along said bottom (90), said structure (86) extending upwardly past said ridge (89) adjacent said one side (91) to adjacent said bottom (90).

6. In a load lifting apparatus (10) having a generally vertically oriented mast assembly (12) and a carriage assembly (16) having an upper generally horizontal member (20) and a lower generally horizontal member (22) and being mounted to and translatable along said mast assembly (12), a side shifter (24) having upper (26) and lower (28) generally horizontal bars connected together and being mounted to and laterally translatable along said members (20 and 22), and a generally "L" shaped tine (36) having a generally vertical leg (38) having a top end portion (40) and a bottom end portion (42) and a generally horizontal leg (44) being associated with said side shifter (24), the improvement comprising:

means (52) for mounting said top end portion (40) of said vertical leg (38) for transferring substantially only horizontal forces from said tine (36) to said upper bar (26);

means (64) for mounting said bottom end portion (42) of said leg (38) for transferring vertical forces from said tine (36) to said lower bar (28);

a first bearing structure (93) attached to and extending along a respective one of said lower bar (28) and said lower member (22) and positioned in sliding contact with the other one of said lower bar (28) and said lower member (22) to transfer forces downwardly from the lower bar (28) to said lower member (22); and a second bearing structure (99) attached to and extending along a respective one of said lower bar (28) and said lower member (22) and positioned in sliding contact with the other one of said lower bar (28) and said lower member (22) to transfer forces upwardly from said lower bar (28) to said lower member (22).

7. The apparatus (10) as set forth in claim 6, further including:

bearing means (108) for providing sliding contact between said lower bar (28) and said lower member (22) for transferring forces generally horizontally between said lower bar (28) and said lower member (22).

8. The apparatus (10) as set forth in claim 7, wherein said first bearing structure (93), said second bearing structure (99) and said bearing means (108) are of an organic polymeric material.

9. The apparatus (10) as set forth in claim 7, including first (92) and second (96) "L" shaped bearing members, each having generally horizontal (93, 99) and vertical (101, 103) legs and wherein said first bearing structure (93) includes said horizontal leg (93) of said first "L" shaped bearing member (92), said second bearing structure (99) includes said horizontal leg (99) of said second "L" shaped bearing member (96) and said bearing means (108) includes said vertical legs (101, 103) of said first and second "L" shaped bearing members (92, 96).

* * * * *